US007033253B2

(12) United States Patent
Dunn

(10) Patent No.: US 7,033,253 B2
(45) Date of Patent: Apr. 25, 2006

(54) POLISHING PAD CONDITIONERS HAVING ABRASIVES AND BRUSH ELEMENTS, AND ASSOCIATED SYSTEMS AND METHODS

(75) Inventor: Freddie L. Dunn, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/917,180

(22) Filed: Aug. 12, 2004

(65) Prior Publication Data

US 2006/0035568 A1 Feb. 16, 2006

(51) Int. Cl.
*B24B 29/00* (2006.01)

(52) U.S. Cl. ..... 451/56; 451/72; 451/57; 451/443; 451/444; 451/464

(58) Field of Classification Search ..... 451/56, 451/57, 72, 443, 444, 461
See application file for complete search history.

(56) References Cited

U.S. PATENT DOCUMENTS

| | | | |
|---|---|---|---|
| 5,069,002 | A | 12/1991 | Sandhu et al. |
| 5,081,796 | A | 1/1992 | Schultz |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,245,790 | A | 9/1993 | Jerbic |
| 5,245,796 | A | 9/1993 | Miller et al. |
| RE34,425 | E | 11/1993 | Schultz |
| 5,421,769 | A | 6/1995 | Schultz et al. |
| 5,433,651 | A | 7/1995 | Lustig et al. |
| 5,449,314 | A | 9/1995 | Meikle et al. |
| 5,486,129 | A | 1/1996 | Sandhu et al. |
| 5,514,245 | A | 5/1996 | Doan et al. |
| 5,533,924 | A | 7/1996 | Stroupe et al. |
| 5,540,810 | A | 7/1996 | Sandhu et al. |
| 5,616,069 | A | 4/1997 | Walker et al. |
| 5,618,381 | A | 4/1997 | Doan et al. |
| 5,643,060 | A | 7/1997 | Sandhu et al. |
| 5,645,682 | A | 7/1997 | Skrovan |
| 5,655,951 | A | 8/1997 | Meikle et al. |
| 5,658,183 | A | 8/1997 | Sandhu et al. |
| 5,658,190 | A | 8/1997 | Wright et al. |
| 5,664,988 | A | 9/1997 | Stroupe et al. |
| 5,679,065 | A | 10/1997 | Henderson |
| 5,679,169 | A | 10/1997 | Gonzales et al. |

(Continued)

OTHER PUBLICATIONS

Kondo, Seiichi, et al., "Abrasive-Free Polishing for Copper Damascene Interconnection," Journal of Electrochemical Society, vol. 147, No. 10, pp. 3907-3913, The Electrochemical Society, Inc., 2000.

*Primary Examiner*—George Nguyen
(74) *Attorney, Agent, or Firm*—Perkins Coie LLP

(57) ABSTRACT

Systems and methods for conditioning polishing pads are disclosed. A system in accordance with one embodiment of the invention includes a polishing support configured to carry a microfeature workpiece polishing pad, and a conditioner positioned at least proximate to the support to condition a polishing pad carried by the support. The conditioner can include a first portion (e.g., an abrasive portion) having a first hardness and being positioned to contact a polishing pad carried by the support, and a second portion (e.g., a brush portion) having a second hardness less than the first hardness and being positioned proximate to the first portion.

66 Claims, 7 Drawing Sheets

U.S. PATENT DOCUMENTS

| | | | | |
|---|---|---|---|---|
| 5,702,292 | A | 12/1997 | Brunelli et al. | |
| 5,725,417 | A | 3/1998 | Robinson | |
| 5,730,642 | A | 3/1998 | Sandhu et al. | |
| 5,747,386 | A | 5/1998 | Moore | |
| 5,779,522 | A | 7/1998 | Walker et al. | |
| 5,782,675 | A | 7/1998 | Southwick | |
| 5,792,709 | A | 8/1998 | Robinson et al. | |
| 5,795,495 | A | 8/1998 | Meikle | |
| 5,801,066 | A | 9/1998 | Meikle | |
| 5,807,165 | A | 9/1998 | Uzoh et al. | |
| 5,830,806 | A | 11/1998 | Hudson et al. | |
| 5,833,519 | A | 11/1998 | Moore | |
| 5,846,336 | A | 12/1998 | Skrovan | |
| 5,851,135 | A | 12/1998 | Sandhu et al. | |
| 5,868,896 | A | 2/1999 | Robinson et al. | |
| 5,879,226 | A | 3/1999 | Robinson | |
| 5,882,248 | A | 3/1999 | Wright et al. | |
| 5,893,754 | A | 4/1999 | Robinson et al. | |
| 5,894,852 | A | 4/1999 | Gonzales et al. | |
| 5,895,550 | A | 4/1999 | Andreas | |
| 5,902,173 | A * | 5/1999 | Tanaka | 451/56 |
| 5,904,615 | A | 5/1999 | Jeong et al. | |
| 5,910,043 | A | 6/1999 | Manzonie et al. | |
| 5,934,980 | A | 8/1999 | Koos et al. | |
| 5,945,347 | A | 8/1999 | Wright | |
| 5,954,912 | A | 9/1999 | Moore | |
| 5,967,030 | A | 10/1999 | Blalock | |
| 5,972,792 | A | 10/1999 | Hudson | |
| 5,975,994 | A | 11/1999 | Sandhu et al. | |
| 5,980,363 | A | 11/1999 | Meikle et al. | |
| 5,981,396 | A | 11/1999 | Robinson et al. | |
| 5,994,224 | A | 11/1999 | Sandhu et al. | |
| 5,997,384 | A | 12/1999 | Blalock | |
| 6,004,196 | A | 12/1999 | Doan et al. | |
| 6,007,406 | A | 12/1999 | Custer et al. | |
| 6,022,266 | A | 2/2000 | Bullard et al. | |
| 6,039,633 | A | 3/2000 | Chopra | |
| 6,040,245 | A | 3/2000 | Sandhu et al. | |
| 6,054,015 | A | 4/2000 | Brunelli et al. | |
| 6,066,030 | A | 5/2000 | Uzoh | |
| 6,074,286 | A | 6/2000 | Ball | |
| 6,083,085 | A | 7/2000 | Lankford | |
| 6,110,820 | A | 8/2000 | Sandhu et al. | |
| 6,116,988 | A | 9/2000 | Ball | |
| 6,120,354 | A | 9/2000 | Koos et al. | |
| 6,135,856 | A | 10/2000 | Tjaden et al. | |
| 6,139,402 | A | 10/2000 | Moore | |
| 6,143,123 | A | 11/2000 | Robinson et al. | |
| 6,143,155 | A | 11/2000 | Adams et al. | |
| 6,152,808 | A | 11/2000 | Moore | |
| 6,152,813 | A * | 11/2000 | Suzuki | 451/443 |
| 6,162,112 | A * | 12/2000 | Miyazaki et al. | 451/36 |
| 6,176,992 | B1 | 1/2001 | Talieh | |
| 6,187,681 | B1 | 2/2001 | Moore | |
| 6,191,037 | B1 | 2/2001 | Robinson et al. | |
| 6,193,588 | B1 | 2/2001 | Carlson et al. | |
| 6,196,899 | B1 | 3/2001 | Chopra et al. | |
| 6,200,196 | B1 | 3/2001 | Custer et al. | |
| 6,200,901 | B1 | 3/2001 | Hudson et al. | |
| 6,203,404 | B1 | 3/2001 | Joslyn et al. | |
| 6,203,413 | B1 | 3/2001 | Skrovan | |
| 6,206,756 | B1 | 3/2001 | Chopra et al. | |
| 6,206,757 | B1 | 3/2001 | Custer et al. | |
| 6,206,760 | B1 | 3/2001 | Chang et al. | |
| 6,210,257 | B1 | 4/2001 | Carlson | |
| 6,213,845 | B1 | 4/2001 | Elledge | |
| 6,213,856 | B1 * | 4/2001 | Cho et al. | 451/443 |
| 6,218,316 | B1 | 4/2001 | Marsh | |
| 6,220,934 | B1 | 4/2001 | Sharples et al. | |
| 6,227,955 | B1 | 5/2001 | Custer et al. | |
| 6,234,874 | B1 | 5/2001 | Ball | |
| 6,234,877 | B1 | 5/2001 | Koos et al. | |
| 6,234,878 | B1 | 5/2001 | Moore | |
| 6,234,883 | B1 | 5/2001 | Berman et al. | |
| 6,237,483 | B1 | 5/2001 | Blalock | |
| 6,238,270 | B1 | 5/2001 | Robinson | |
| 6,241,587 | B1 | 6/2001 | Drill et al. | |
| 6,244,944 | B1 | 6/2001 | Elledge | |
| 6,250,994 | B1 | 6/2001 | Chopra et al. | |
| 6,251,785 | B1 | 6/2001 | Wright | |
| 6,261,151 | B1 | 7/2001 | Sandhu et al. | |
| 6,261,163 | B1 | 7/2001 | Walker et al. | |
| 6,267,650 | B1 | 7/2001 | Hembree | |
| 6,273,101 | B1 | 8/2001 | Gonzales et al. | |
| 6,273,786 | B1 | 8/2001 | Chopra et al. | |
| 6,273,796 | B1 | 8/2001 | Moore | |
| 6,273,800 | B1 | 8/2001 | Walker et al. | |
| 6,276,996 | B1 | 8/2001 | Chopra | |
| 6,302,771 | B1 | 10/2001 | Liu et al. | |
| 6,306,008 | B1 | 10/2001 | Moore | |
| 6,306,012 | B1 | 10/2001 | Sabde | |
| 6,306,014 | B1 | 10/2001 | Walker et al. | |
| 6,306,768 | B1 | 10/2001 | Klein | |
| 6,309,433 | B1 | 10/2001 | Kinoshita | |
| 6,312,558 | B1 | 11/2001 | Moore | |
| 6,328,632 | B1 | 12/2001 | Chopra | |
| 6,331,136 | B1 | 12/2001 | Bass et al. | |
| 6,331,139 | B1 | 12/2001 | Walker et al. | |
| 6,331,488 | B1 | 12/2001 | Doan et al. | |
| 6,343,977 | B1 | 2/2002 | Peng et al. | |
| 6,350,180 | B1 | 2/2002 | Southwick | |
| 6,350,691 | B1 | 2/2002 | Lankford | |
| 6,352,466 | B1 | 3/2002 | Moore | |
| 6,352,470 | B1 | 3/2002 | Elledge | |
| 6,354,923 | B1 | 3/2002 | Lankford | |
| 6,354,930 | B1 | 3/2002 | Moore | |
| 6,358,122 | B1 | 3/2002 | Sabde et al. | |
| 6,358,127 | B1 | 3/2002 | Carlson et al. | |
| 6,358,129 | B1 | 3/2002 | Dow | |
| 6,361,411 | B1 | 3/2002 | Chopra et al. | |
| 6,361,413 | B1 | 3/2002 | Skrovan | |
| 6,361,417 | B1 | 3/2002 | Walker et al. | |
| 6,364,757 | B1 | 4/2002 | Moore | |
| 6,368,190 | B1 | 4/2002 | Easter et al. | |
| 6,368,193 | B1 | 4/2002 | Carlson et al. | |
| 6,368,194 | B1 | 4/2002 | Sharples et al. | |
| 6,368,197 | B1 | 4/2002 | Elledge | |
| 6,371,836 | B1 * | 4/2002 | Brown et al. | 451/56 |
| 6,376,381 | B1 | 4/2002 | Sabde | |
| 6,383,934 | B1 | 5/2002 | Sabde et al. | |
| 6,387,289 | B1 | 5/2002 | Wright | |
| 6,395,620 | B1 | 5/2002 | Pan et al. | |
| 6,402,884 | B1 | 6/2002 | Robinson et al. | |
| 6,428,386 | B1 | 8/2002 | Bartlett | |
| 6,447,369 | B1 | 9/2002 | Moore | |
| 6,498,101 | B1 | 12/2002 | Wang | |
| 6,500,054 | B1 | 12/2002 | Ma et al. | |
| 6,511,576 | B1 | 1/2003 | Klein | |
| 6,517,416 | B1 | 2/2003 | Crevasse et al. | |
| 6,520,834 | B1 | 2/2003 | Marshall | |
| 6,533,893 | B1 | 3/2003 | Sabde et al. | |
| 6,666,749 | B1 | 3/2003 | Taylor | |
| 6,547,640 | B1 | 4/2003 | Hofmann | |
| 6,548,407 | B1 | 4/2003 | Chopra et al. | |
| 6,579,799 | B1 | 6/2003 | Chopra et al. | |
| 6,592,443 | B1 | 7/2003 | Kramer et al. | |
| 6,609,947 | B1 | 8/2003 | Moore | |
| 6,623,329 | B1 | 9/2003 | Moore | |
| 6,640,816 | B1 | 11/2003 | Gonzales et al. | |
| 6,652,764 | B1 | 11/2003 | Blalock | |
| 6,695,680 | B1 | 2/2004 | Choi et al. | |
| 2003/0190874 | A1 * | 10/2003 | So | 451/56 |

* cited by examiner

POLISHING PAD CONDITIONERS HAVING ABRASIVES AND BRUSH ELEMENTS, AND ASSOCIATED SYSTEMS AND METHODS

TECHNICAL FIELD

The present invention is directed generally toward polishing pad conditioners having abrasives and brush elements, and associated systems and methods.

BACKGROUND

Mechanical and chemical-mechanical planarization and polishing processes (collectively "CMP") remove material from the surfaces of microfeature workpieces in the production of microelectronic devices and other products. FIG. 1A schematically illustrates a rotary CMP machine 10 having a platen 22, a polishing pad 20 on the platen 22, and a carrier 30 adjacent to the polishing pad 20. The CMP machine 10 may also have an under-pad 23 between an upper surface 21 of the platen 22 and a lower surface of the polishing pad 20. A platen drive assembly 24 rotates the platen 22 (as indicated by arrow A) and/or reciprocates the platen 22 back and forth (as indicated by arrow B). Because the polishing pad 20 is attached to the under-pad 23, the polishing pad 20 moves with the platen 22 during planarization.

The carrier 30 has a carrier head 31 with a lower surface 33 to which a microfeature workpiece 12 may be attached, or the workpiece 12 may be attached to a resilient pad 32 under the lower surface 33. The carrier head 31 may be a weighted, free-floating wafer carrier, or a carrier actuator assembly 34 may be attached to the carrier head 31 to impart rotational motion to the microfeature workpiece 12 (as indicated by arrow C) and/or reciprocate the workpiece 12 back and forth (as indicated by arrow D).

The polishing pad 20 and a polishing solution 11 define a polishing medium 13 that mechanically and/or chemically-mechanically removes material from the surface of the microfeature workpiece 12. The polishing solution 11 may be a conventional CMP slurry with abrasive particles and chemicals that etch and/or oxidize the surface of the microfeature workpiece 12, or the polishing solution 11 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the microfeature workpiece 12 with the CMP machine 10, the carrier head 31 presses the workpiece 12 face-down against the polishing pad 20. More specifically, the carrier head 31 generally presses the microfeature workpiece 12 against the polishing solution 11 on a polishing surface 25 of the polishing pad 20, and the platen 22 and/or the carrier head 31 move to rub the workpiece 12 against the polishing surface 25. As the microfeature workpiece 12 rubs against the polishing surface 25, the polishing medium 13 removes material from the face of the workpiece 12.

The CMP process must consistently and accurately produce a uniformly planar surface on the microfeature workpiece 12 to enable precise fabrication of circuits and photo-patterns. One problem with existing CMP methods is that the polishing surface 25 of the polishing pad 20 can wear unevenly or become glazed with accumulations of polishing solution 11 and/or material removed from the microfeature workpiece 12 and/or the polishing pad 20. To restore the planarizing/polishing characteristics of the polishing pad 20, the pad 20 is typically conditioned by removing the accumulations of waste matter with a conditioner 40. Such conditioners and conditioner assemblies are available on most CMP polishing tools, such as those manufactured by Applied Materials of Santa Clara, Calif. under the trade name Mirra.

The existing conditioner 40 typically includes an abrasive end effector 50 having a head 51 generally embedded with diamond abrasives. The head 51 is attached to a shaft 42 which connects to a shaft housing 49. The shaft housing 49 is supported relative to the polishing pad 20 by an arm 43 and a support housing 44. A motor 46 within the support housing 44 rotates the shaft housing 49, the shaft 42 and the head 51 (as indicated by arrow E) via a pair of pulleys 47*a*, 47*b* and a connecting belt 48. The conditioner 40 can also include a separate actuator (not shown in FIG. 1A) that sweeps the arm 43 and the end effector 50 back and forth (as indicated by arrow F). A bladder 41 rotates with the shaft 42 and applies a normal force to the head 51 (as indicated by arrow G) to press the head 51 against the polishing pad 20. The end effector 50 accordingly removes a thin layer of the polishing pad material in addition to the waste matter to form a new, clean polishing surface 25 on the polishing pad 20.

After the end effector 50 removes material from the polishing pad 20, the loose material is typically brushed off the polishing pad 20. FIG. 1B illustrates a brush 38 having bristles 37 that pass over the polishing surface 25 of the polishing pad 20. Accordingly, the bristles 37 can remove loose material from the polishing pad 20 and can clean the exposed surfaces of fixed abrasive elements 26 embedded in projections 19 of the polishing pad 20. The brush 38 is typically attached to the end effector 50 (FIG. 1A) in place of the diamond abrasive head 51 (FIG. 1A). One drawback with the foregoing arrangement (as described in further detail below) is that it may not adequately condition the polishing pad 20, which can reduce the uniformity with which the polishing pad 20 removes material from the workpiece 12. Another drawback is that it may be time consuming to exchange the abrasive head 51 and the brush 38 during conditioning operations.

DETAILED DESCRIPTION

Figure 1A:
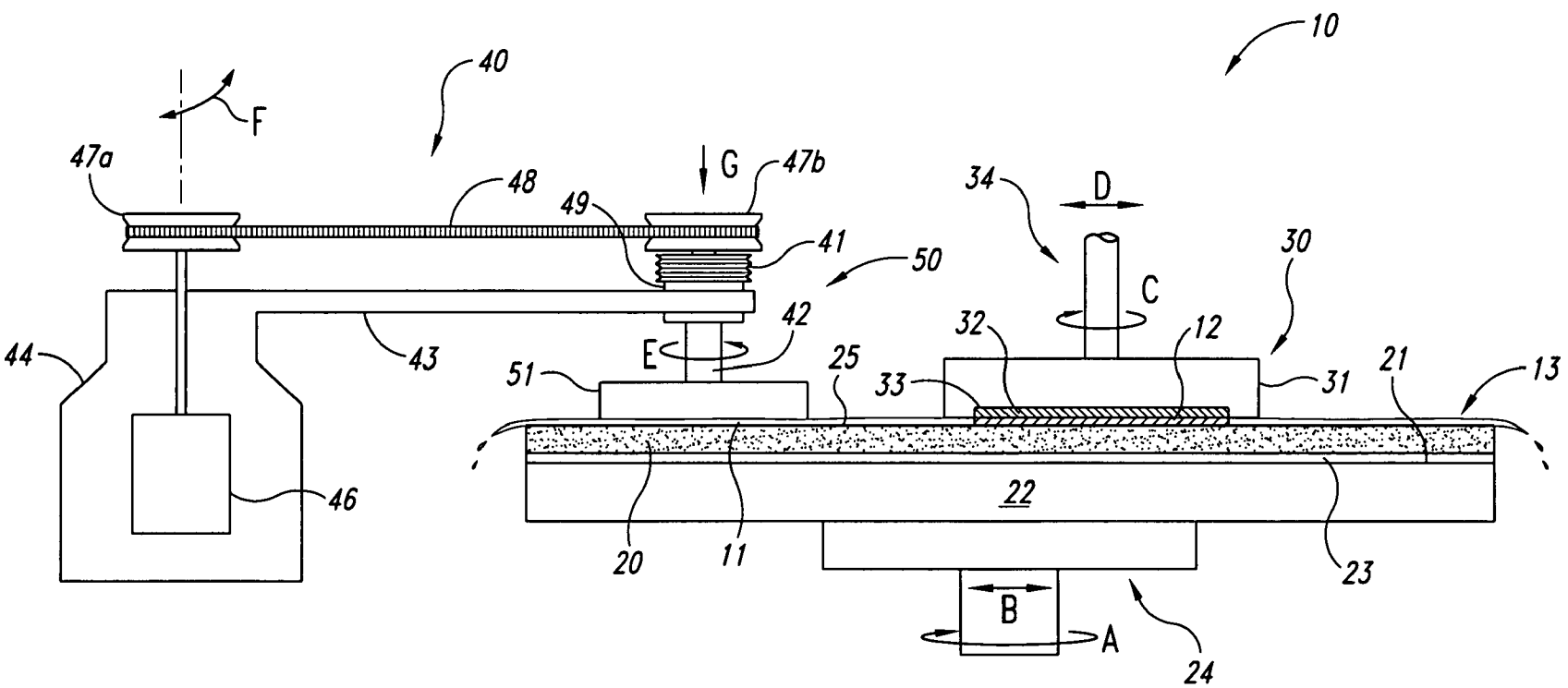
Fig. 1A (Prior Art)
FIG. 1A is a partially schematic, side elevation view of a CMP system having a polishing pad and a conditioner arranged in accordance with the prior art.
Figure 1B:
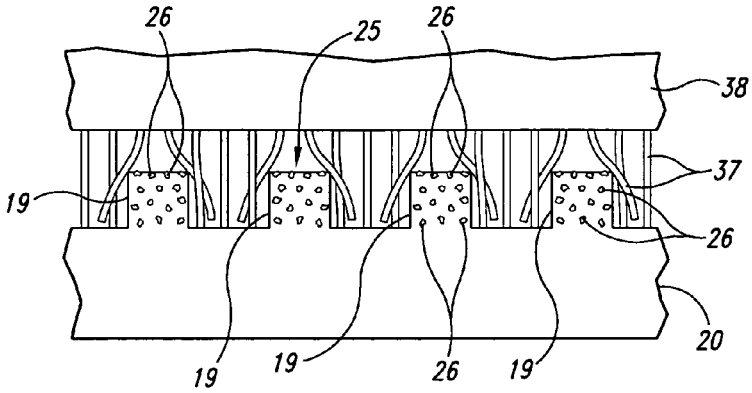
Fig. 1B (Prior Art)
FIG. 1B is an enlarged, partially schematic, illustration of a portion of a polishing pad and a brush used to clean the polishing pad in accordance with the prior art.

The present invention is directed generally toward polishing pad conditioners having abrasives and brush elements, and associated systems and methods. One of the drawbacks associated with the arrangement described above with reference to FIGS. 1A and 1B is that it may actually embed material into the polishing pad. For example, one portion of the hard abrasive surface of the conditioning head may remove material from the polishing pad during conditioning, but then another portion of the abrasive surface may re-embed the material as the conditioning head moves over the polishing pad during normal conditioning operations. While existing brushes may be adequate for removing material that lies loosely on the surface of the polishing pad, they are not typically able to remove material that has been re-embedded into the polishing pad. As a result, conditioning the polishing pad with existing devices may not provide the desired level of pad quality and/or uniformity.

One aspect of the invention is directed toward a system that includes features for conditioning microfeature workpiece polishing media. The system can include a polishing pad support having a support surface positioned to carry a microfeature workpiece polishing pad, and a conditioner positioned at least proximate to the polishing pad support to condition a polishing pad carried by the polishing pad support. The conditioner can include a first portion having a first hardness and positioned to contact the polishing pad carried by the polishing pad support, and a second portion having a second hardness less than the first hardness and positioned proximate to the first portion. In further particular embodiments, the first portion can include an abrasive surface and the second portion can include a plurality of brush elements. In still further particular embodiments, the first and second portions can have fixed positions relative to each other, and the first portion can contact the polishing pad simultaneously with the second portion.

A method for conditioning microfeature workpiece polishing media can include positioning a polishing pad conditioner proximate to a microfeature workpiece polishing pad, with the polishing pad conditioner having a first portion and a second portion proximate to the first portion. The first portion can have a first hardness and the second portion can have a second hardness less than the first hardness. The method can further include contacting the polishing pad with the first portion of the polishing pad conditioner, and removing material from the polishing pad by moving at least one of the polishing pad and the first portion relative to the other while the first portion contacts the polishing pad. The method can further include contacting the polishing pad with the second portion of the conditioner, and sweeping material removed from the polishing pad by moving at least one of the polishing pad and the second portion relative to the other while the second portion contacts the polishing pad.

As used herein, the terms "microfeature workpiece" and "workpiece" refer to substrates in and/or on which microelectronic devices are integrally formed. Microfeature polishing pads include pads configured to remove material from microfeature workpieces during the formation of microdevices. Typical microdevices include microelectronic circuits or components, thin-film recording heads, data storage elements, microfluidic devices, and other products. Micromachines and micromechanical devices are included within this definition because they are manufactured using much of the same technology that is used in the fabrication of integrated circuits. Substrates can be semiconductive pieces (e.g., doped silicon wafers or gallium arsenide wafers), nonconductive pieces (e.g., various ceramic substrates), or conductive pieces. In some cases, the workpieces are generally round, and in other cases, the workpieces have other shapes, including rectilinear shapes. Several embodiments of conditioners used to remove material from microfeature polishing pads, and associated systems and methods, are described below. A person skilled in the relevant art will understand, however, that the invention may have additional embodiments, and that the invention may be practiced without several of the details of the embodiments described below with reference to FIGS. 2A–6. For purposes of clarity and illustration, at least some of the elements shown in FIGS. 2A–6 are not drawn to scale.

Figure 2A:
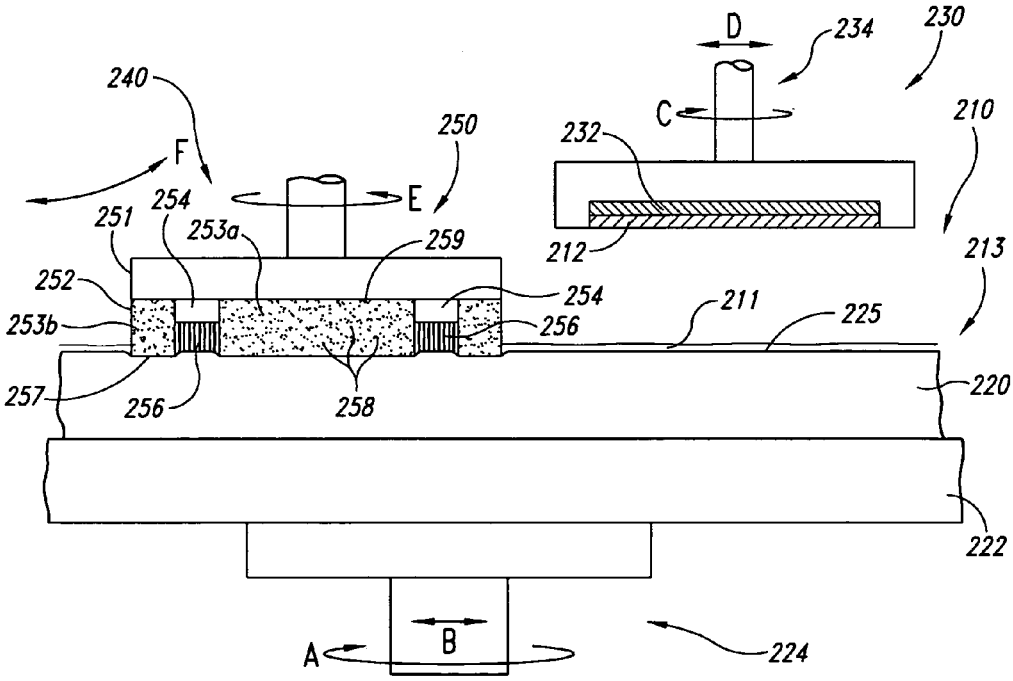
FIG. 2A is a partially schematic, side elevation view of a portion of a system used to condition a polishing pad in accordance with an embodiment of the invention.
Figure 2B:
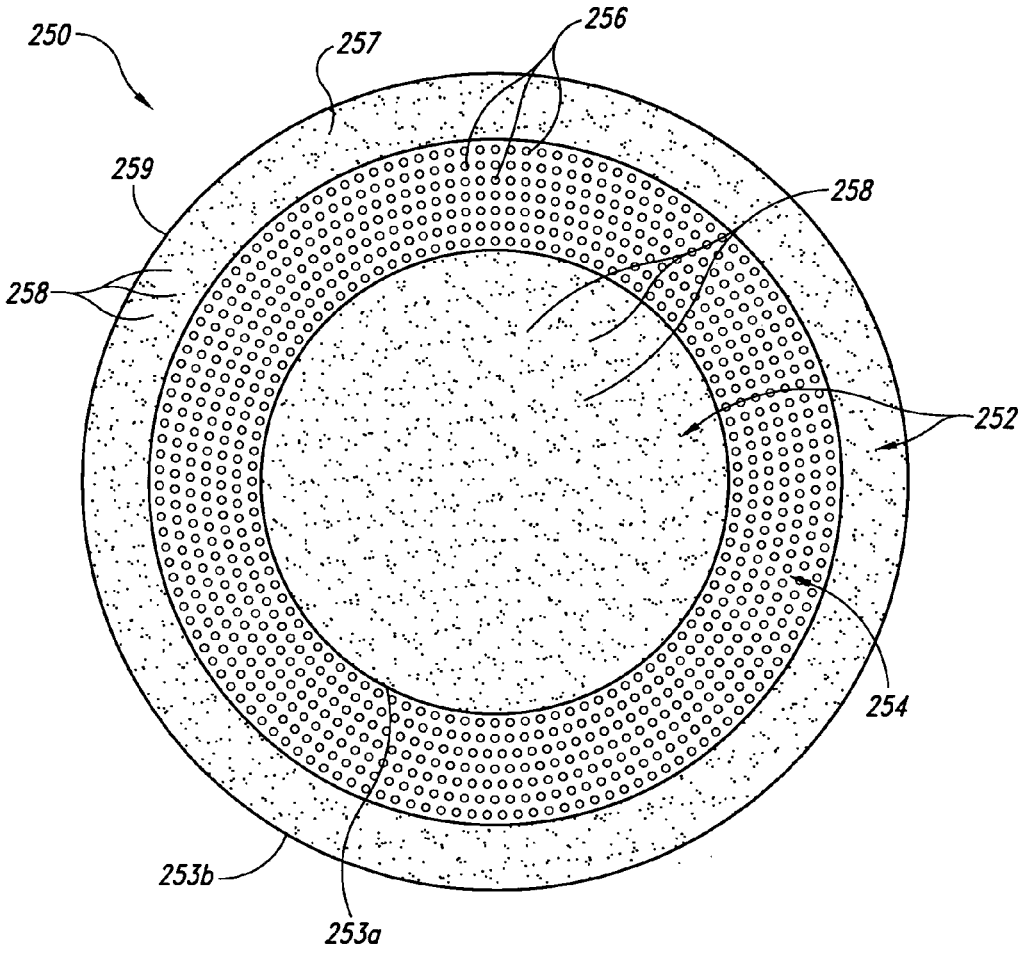
FIG. 2B is a bottom view of an end effector portion of the system shown in FIG. 2A.

FIG. 2A is a partially schematic, side elevation view of a system 210 that includes a conditioner 240 having an end effector 250 configured in accordance with an embodiment of the invention. FIG. 2B is a bottom view of a portion of the end effector 250 shown in FIG. 2A. Referring first to FIG. 2A, the system 210 can include a platen 222 that supports a polishing pad 220 (e.g., a non-abrasive, urethane polishing pad) having a polishing surface 225. The platen 222 can be coupled to a drive assembly 224 for rotating the polishing pad 220 (as indicated by arrow A) and/or reciprocating the polishing pad 220 (as indicated by arrow B) during polishing and/or conditioning operations. The polishing pad 220 can carry a polishing liquid 211, and the polishing pad 220, with or without the polishing liquid 211, can define a polishing medium 213 for removing material from a microfeature workpiece 212.

A carrier 230 is positioned to support the microfeature workpiece 212 relative to the polishing pad 220. Accordingly, the carrier 230 can bear directly against the microfeature workpiece 212, or optionally, a resilient pad 232 can be positioned between the microfeature workpiece 212 and a downwardly facing surface of the carrier 230. An actuator assembly 234 can rotate and/or reciprocate the carrier 230 and the workpiece 212 relative to the polishing pad 220 to remove material from the workpiece 212, as indicated by arrows C and D, respectively.

The material removed from the workpiece 212 can form deposits and/or glazes on the polishing surface 225. The conditioner 240 can remove deposited materials from the polishing surface 225 of the polishing pad 220, either after or while material is being removed from the microfeature workpiece 212. Accordingly, the end effector 250 of the conditioner 240 can rotate relative to the polishing pad 220 (as indicated by arrow E) and/or sweep back and forth over the polishing surface 225 (as indicated by arrow F). The end effector 250 can include a head 251 that carries a first portion (e.g., an abrasive portion 252) having a first hardness, and a second portion (e.g., a brush portion 254) having a second hardness less than the first hardness. Both portions 252, 254 can be configured to contact the polishing surface 225 of the polishing pad 220. In a particular aspect of this embodiment, the abrasive portion 252 and the brush portion 254 have fixed positions relative to each other, and contact the polishing pad 220 simultaneously. Accordingly, the brush portion 254 can sweep material loosened by the abrasive portion 252 from the polishing surface 225, before the abrasive portion 252 re-embeds the loosened material.

In a particular embodiment, the brush portion 254 can include brush elements 256 (e.g., bristles), and the abrasive portion 252 can include an abrasive surface 257. The ends of the brush elements 256 can be recessed from the abrasive surface 257 so that the brush elements 256 are not crushed or bent when the end effector 250 is pressed against the polishing pad 220 during conditioning. Accordingly, the abrasive surface 257 can locally depress the polishing surface 225, and the brush elements 256 can contact the adjacent, non-depressed regions of the polishing surface 225. In another embodiment, e.g., as described below with reference to FIG. 3A, the abrasive surface 257 can be recessed relative to the brush elements 256, for example, when it is desirable to press the brush elements 256 against the polishing pad 220 with an additional force.

Referring now to FIGS. 2A and 2B together, the abrasive portion 252 can include a substrate material 259 carrying abrasive particles 258, for example, diamond particles. The abrasive portion 252 can include multiple regions 253, shown as an inner region 253*a* disposed inwardly from the brush portion 254, and an outer region 253*b* disposed annularly outwardly from the brush portion 254. Each region 253 can include a matrix material (e.g., nickel carbide) embedded with abrasive elements (e.g., diamond particles).

One feature of an embodiment of the conditioner 240 described above with reference to FIGS. 2A and 2B is that it can include both an abrasive surface 257 and brush elements 256. The abrasive surface 257 and the brush elements 256 can be mounted to a common end effector 250 to move together during conditioning. An advantage of this feature is that particles loosened by the abrasive surface 257 can be brushed away by the brush elements 256 before they are re-embedded into the polishing surface 225. As a result, the end effector 250 can more effectively remove materials from the polishing surface 225. For example, the end effector 250 can remove more material from the polishing surface 225 than can existing end effectors, and can do so in a more uniform manner than can existing end effectors. Accordingly, the conditioned polishing pad 220 can remove material from microfeature workpieces 212 at an increased rate, and/or with an increased spatial uniformity.

Another advantage of the foregoing features is an operator need not remove an abrasive head from a conditioner and replace it with a head having brush elements as part of the process of conditioning the polishing pad 220. As a result, the process of conditioning the polishing pad 220 can take less time.

In other embodiments, the conditioner 240 includes an abrasive surface 257 and brush elements 256 that are coupled to each other but can move relative to each other during conditioning. Relative motion between the abrasive surface 257 and the brush elements 256 can be coordinated to prevent material loosened from the polishing pad 220 from being re-embedded in the polishing surface 225. In further embodiments, the abrasive portion 252 and the brush portion 254 can include different constituents. For example, the abrasive surface 257 can include different matrix materials and abrasive elements, and the brush elements can include elements (other than bristles) that are softer than the abrasive surface 257. Such elements can include foam, cloth and/or other materials. In still further embodiments, the spatial relationship between the abrasive surface 257 and the brush elements 256 can be different, as described below with reference to FIGS. 3A–5.

Figure 3A:
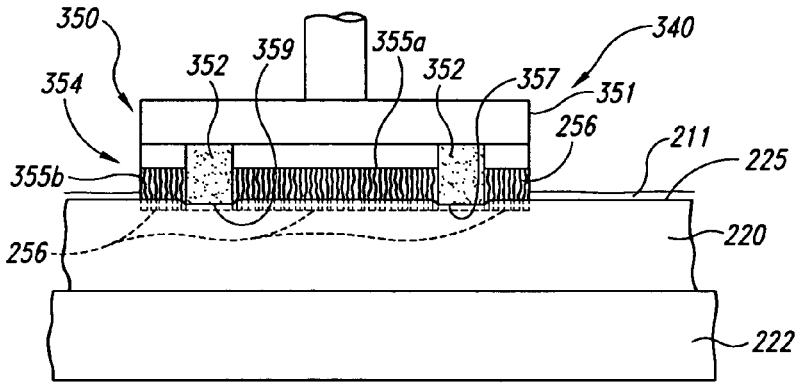
FIG. 3A is a partially schematic, side elevation view of a portion of a system configured to condition a polishing pad in accordance with another embodiment of the invention.
Figure 3B:
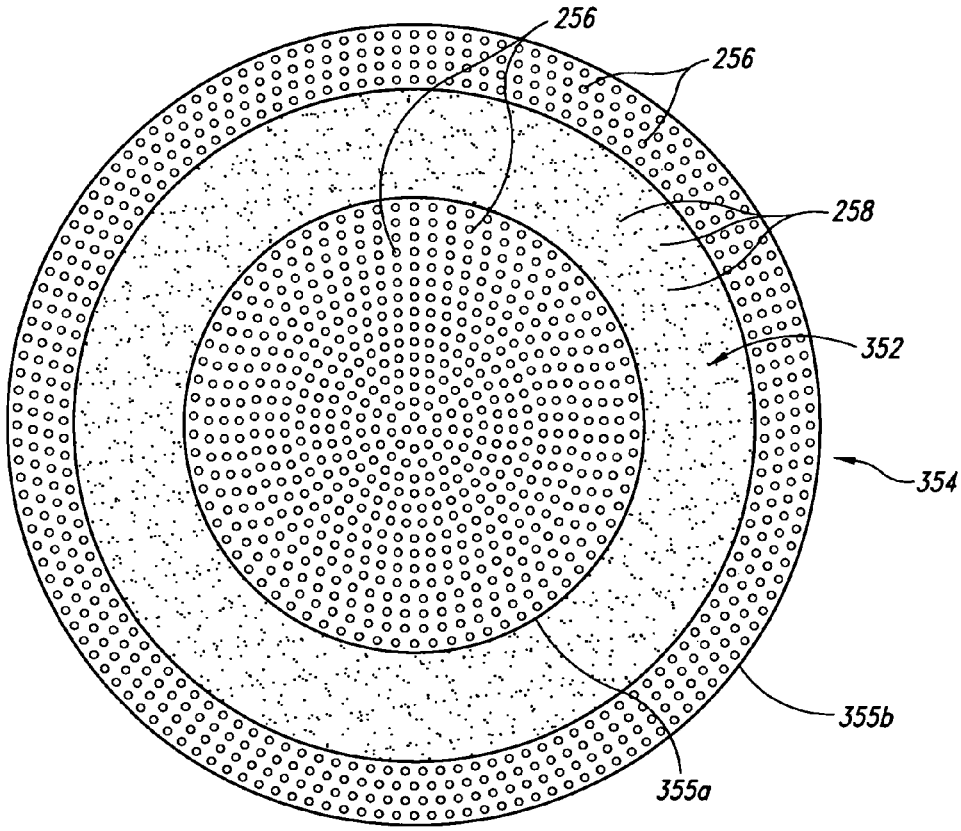
FIG. 3B is a bottom view of an end effector portion of the system shown in FIG. 3A.

FIG. 3A is a partially schematic, side elevation view of a conditioner 340 having an end effector 350 configured in accordance with another embodiment of the invention. The end effector 350 can include a head 351 that carries an abrasive portion 352 and a brush portion 354. FIG. 3B is a bottom view of the head 351. Referring now to both FIGS. 3A and 3B, the brush portion 354 can include an inner region 355*a* disposed annularly inwardly from the abrasive portion 352, and an outer region 355*b* disposed annularly outwardly from the abrasive portion 352. In a particular aspect of this embodiment, the abrasive portion 352 can include an abrasive surface 357 that is initially recessed from the brush elements 256. Accordingly, the brush elements 256 can initially extend beyond the abrasive surface 357, as indicated in dashed lines in FIG. 3A. When the head 351 is pressed against the polishing surface 252, the abrasive surface 357 can locally depress the polishing surface 252, and the brush elements 256 can bend, deflect or otherwise deform (as shown in solid lines in FIG. 3A) due to the pressure placed upon them. In another embodiment, a similar effect can be achieved by sizing the brush elements 256 to be at least approximately flush with the abrasive surface 357 when the end effector 350 is not pressing the head 351 against the polishing surface 252. An advantage of either of the foregoing arrangements is that they can allow the brush elements 256 to exert additional force on the polishing surface 252. In at least some situations, the additional force can more effectively sweep loosened material from the polishing surface 252, and can prevent such loosened material from becoming re-embedded in the polishing surface 252.

Figure 4:
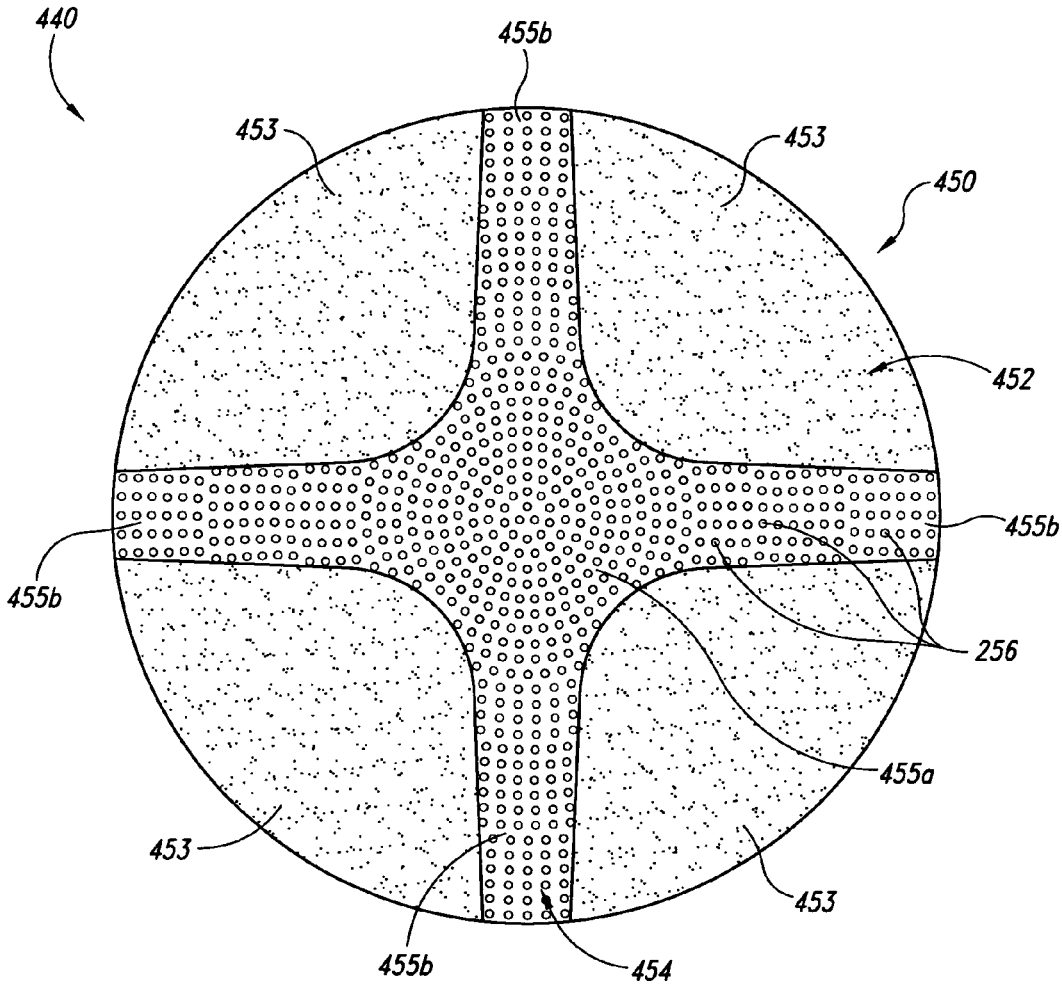
FIG. 4 is a bottom view of an end effector configured in accordance with another embodiment of the invention.
Figure 5:
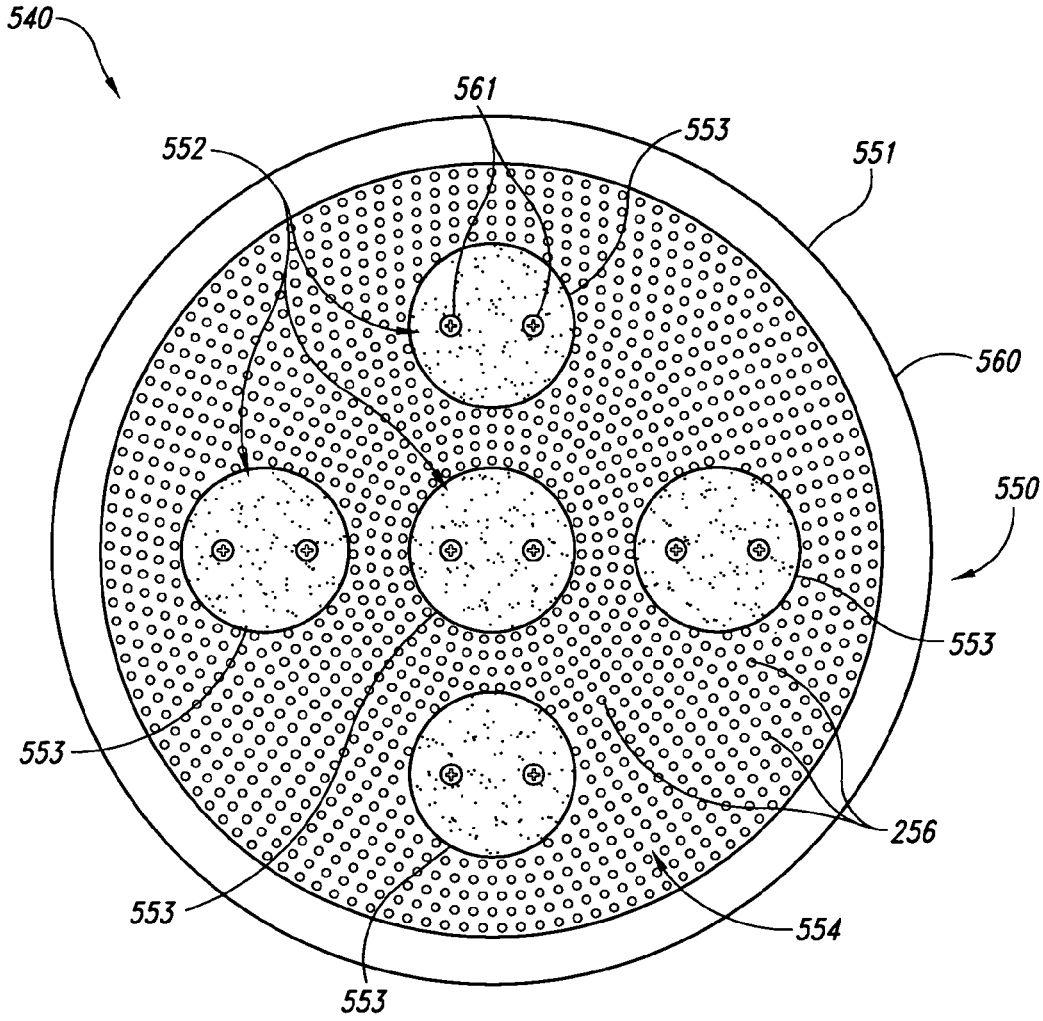
FIG. 5 is a bottom view of an end effector having portions removably attached to a head in accordance with yet another embodiment of the invention.

FIG. 4 illustrates a conditioner 440 having an end effector 450 that carries an abrasive portion 452 and a brush portion 454 having brush elements 256 arranged in a cross-shaped pattern. Accordingly, the brush portion 454 can include a central region 455*a* and multiple arm regions 455*b* (four are shown in FIG. 4) extending outwardly from the central region 455*a*. The abrasive portion 452 can include four intermediate regions 453 positioned between neighboring arm regions 455*b*. In other embodiments, the end effector 450 can include more or fewer arm regions 455*b* and corresponding intermediate regions 453. In any of these embodiments, when the end effector 450 is rotated, the brush elements 256 in the arm regions 455*b* follow the motion of the abrasive intermediate regions 453 to brush away loosened material before the next intermediate region 453 re-embeds the loosened material. In still further embodiments, the abrasive portion 452 can have a cross-shaped pattern, and the brush portion 454 can include intermediate regions between arms of the abrasive portion.

An operator can select the particular arrangement of abrasive portions and brush portions based upon the expected dominant relative motion between the conditioner and the polishing pad. For example, when the expected dominant relative motion is a rotational motion of the end effector and/or the polishing pad, (as indicated by arrow E in FIG. 2A), the operator may select a brush portion having a cross-shaped pattern, as shown in FIG. 4. When the expected dominant relative motion is a sweeping motion (e.g., as indicated by arrow F of FIG. 2A), the operator may select a brush portion that is positioned annularly relative to the abrasive portion, as indicated in FIG. 2A or FIG. 3A. In still further embodiments, the relative shapes and sizes of the abrasive portions and brush portions can be different, for either of the two types of motion described above, and/or for other types of relative motion between the conditioner and the polishing pad.

In any of the foregoing embodiments, the abrasive portions and/or the brush portions can be removably attached to the conditioner head. For example, referring to an embodiment shown in FIG. 5, a conditioner 540 can include an end effector 550 having a head 551 that supports an abrasive portion 552 and a brush portion 554. The brush portion 554 can have a generally circular shape, and can be positioned annularly inwardly from a head rim 560. The abrasive portion 552 can include a plurality of generally circular abrasive regions 553 positioned in correspondingly circular cut-out regions of the brush portion 554. Each abrasive region 553 can be releasably attached to the head 551, for example, with threaded fasteners 561. The brush portion 555 can be fixedly attached to the head 551, or it, too, can be releasably attached to the head 551, for example, with threaded fasteners.

An advantage of an arrangement for which the abrasive portion 552 and/or the brush portion 554 is releasably attached to the head 551 is that each portion can be removed independently of the other. Accordingly, if one portion or region wears more rapidly than another, it can be easily removed from the head 551 and replaced, without requiring that the remaining portion or regions (which may still have significant useful life remaining) also be removed. Accordingly, this arrangement can reduce the operating costs associated with the conditioner 540.

Figure 6:
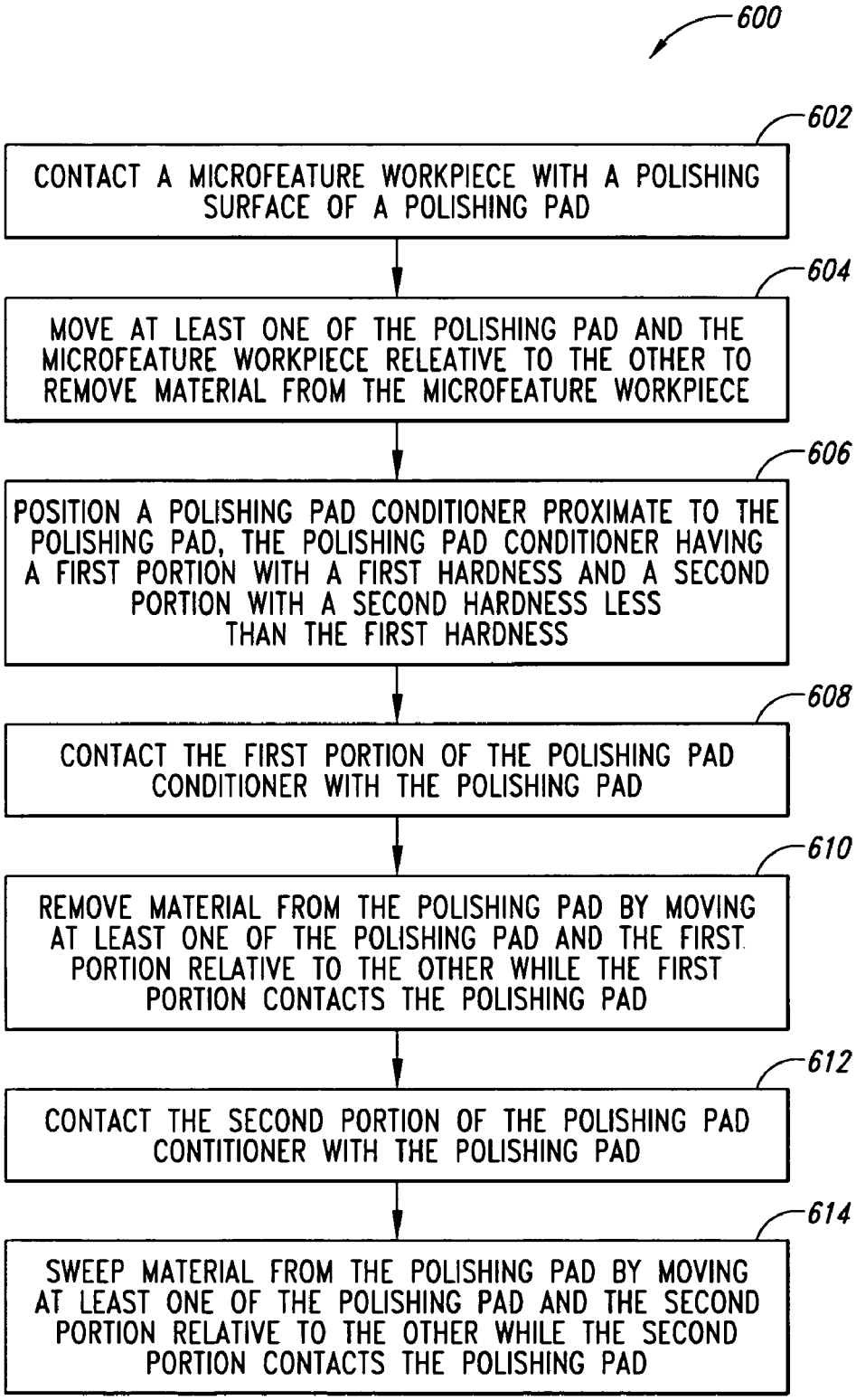
FIG. 6 is a flow diagram illustrating a method for conditioning microfeature workpieces in accordance with an embodiment of the invention.

FIG. 6 is a flow diagram illustrating a process 600 for processing microfeature workpieces with a polishing pad and treating the polishing pad. The process 600 can include contacting a microfeature workpiece with a polishing surface of a polishing pad (process portion 602), and moving at least one of the polishing pad and the microfeature workpiece relative to the other to remove material from the microfeature workpiece (process portion 604). In process portion 606, a polishing pad conditioner is positioned proximate to the polishing pad. The polishing pad conditioner has a first portion with a first hardness (e.g., an abrasive portion with an abrasive surface), and a second portion with a second hardness less than the first hardness (e.g., a brush portion with a plurality of brush elements). In process portion 608, the first portion of the polishing pad conditioner is contacted with the polishing pad, and in process portion 610, material is removed from the polishing pad by moving at least one of the polishing pad and the first position relative to the other while the first portion contacts the polishing pad.

In process portion 612, the second portion of the polishing pad conditioner is contacted with the polishing pad. In process portion 614, materials (e.g., materials loosened by the abrasive surface) are swept from the polishing pad by moving at least one of the polishing pad portion and the second portion relative to the other while the second portion contacts the polishing pad. In further particular embodiments, the second portion can be contacted with the polishing pad simultaneously with contacting the first portion with the polishing pad, and while the first and second portions have fixed positions relative to each other.

From the foregoing, it will be appreciated that specific embodiments of the invention have been described herein for purposes of illustration, but that various modifications may be made without deviating from the spirit and scope of the invention. For example, aspects of the invention described in the context of particular embodiments can be combined or eliminated in other embodiments. Aspects of the invention described in the context of a rotary-type CMP apparatus can also be used with CMP devices having other arrangements, e.g., web-format arrangements. Accordingly, the invention is not limited except as by the appended claims.

I claim:

1. A system including, features for conditioning microfeature workpiece polishing media, the system comprising:

a polishing pad support having a support surface positioned to carry a microfeature workpiece polishing pad; and a conditioner positioned at least proximate to the polishing pad support to condition a polishing pad carried by the polishing pad support, the conditioner including:

an abrasive portion having an abrasive surface positioned to contact the polishing pad carried by the polishing pad support; and a brush portion having brush elements positioned proximate to the abrasive portion, wherein the brush portion includes a first brush region and a second brush region, the abrasive portion is positioned outwardly from the first brush region, and the second brush region is positioned outwardly from the abrasive portion.

2. The system of claim 1 wherein the brush elements are positioned to contact the polishing pad simultaneously with the abrasive surface contacting the polishing pad.

3. The system of claim 1 wherein the abrasive surface includes diamonds.

4. The system of claim 1 wherein the conditioner includes a head and wherein the head carries the abrasive portion and the brush portion of the conditioner.

5. The system of claim 1 wherein the conditioner includes a head and wherein the head carries the abrasive portion and the brush portion of the conditioner, further wherein at least one of the brush portion and the abrasive portion is releasably attached to the head.

6. The system of claim 1 wherein the abrasive portion includes several abrasive regions, each having a part of the abrasive surface.

7. The system of claim 1 wherein the brush portion includes several brush regions, each having some of the brush elements.

8. The system of claim 1 wherein the brush elements include brush bristles that are recessed from the abrasive surface.

9. The system of claim 1 wherein the brush elements include brush bristles that that are at least approximately flush with the abrasive surface.

10. The system of claim 1 wherein the brush elements include brush bristles and wherein the abrasive surface is recessed from the brush bristles.

11. The system of claim 1 wherein at least one of the conditioner and the polishing pad support is movable relative to the other, and wherein the abrasive portion and the brush portion have a fixed position relative to each other during conditioning.

12. The system of claim 1, further comprising the polishing pad.

13. The system of claim 1, further comprising a carrier positioned at least proximate to the polishing pad support and configured to releasably carry a microfeature workpiece.

14. A system including features for conditioning microfeature workpiece polishing media, the system comprising:

a polishing pad support having a support surface positioned to carry a microfeature workpiece polishing pad;

a microfeature workpiece polishing pad carried by the polishing pad support; and a conditioner positioned at least proximate to the polishing pad support to condition the polishing pad, the conditioner including:

an abrasive portion having an abrasive surface positioned to contact the polishing pad;

a brush portion having brush elements positioned to contact the polishing pad simultaneously with the abrasive surface contacting the polishing pad, the brush portion having a fixed position relative to the abrasive portion, wherein the brush portion includes a first brush region and a second brush region, the abrasive portion is positioned outwardly from the first brush region, and the second brush region is positioned outwardly from the abrasive portion; and an actuator coupled to at least one of the polishing pad support and the conditioner to provide relative movement between polishing pad and the conditioner.

15. The system of claim 14 wherein the conditioner includes a head and wherein the head carries the abrasive portion and the brush portion, further wherein at least one of the brush portion and the abrasive portion is releasably attached to the head.

16. The system of claim 14 wherein the abrasive portion includes several abrasive regions, each having a part of the abrasive surface.

17. The system of claim 14 wherein the brush portion is one of several brush portions, each having some of the brush elements.

18. The system of claim 14, further comprising a carrier positioned at least proximate to the polishing pad support and configured to releasably carry a microfeature workpiece.

19. A system including features for conditioning microfeature workpiece polishing media, the system comprising:

a polishing pad support having a support surface positioned to carry a microfeature workpiece polishing pad; and a conditioner positioned at least proximate to the polishing pad support to condition a polishing pad carried by the polishing pad support, the conditioner including:

a first portion having a first hardness and being positioned to contact a polishing pad carried by the polishing pad support; and a second portion having a second hardness less than the first hardness and being positioned proximate to the first portion, wherein the second portion includes an inner region and an outer region, the first portion is positioned outwardly from the inner region, and the outer region is positioned outwardly from the first portion.

20. The system of claim 19 wherein the second portion is positioned to contact the polishing pad simultaneously with the first portion contacting the polishing pad.

21. The system of claim 19 wherein the second portion has a fixed position relative to the first portion.

22. The system of claim 19 wherein the first portion includes an abrasive surface.

23. The system of claim 19 wherein the second portion includes a plurality of brush elements.

24. A method for operating a system having features for conditioning microfeature workpiece polishing media, the method comprising:

positioning a polishing pad conditioner proximate to a microfeature workpiece polishing pad, the polishing pad conditioner having an abrasive portion and a brush portion proximate to the abrasive portion, the abrasive portion having an abrasive surface, the brush portion having a plurality of brush elements, wherein the brush portion includes a first brush region and a second brush region, the abrasive portion is positioned outwardly from the first brush region, and the second brush region is positioned outwardly from the abrasive portion;

contacting the abrasive surface of the polishing pad conditioner with the polishing pad;

removing material from the polishing pad by moving at least one of the polishing pad and the abrasive surface relative to the other while the abrasive surface contacts the polishing pad;

contacting the brush elements of the polishing pad conditioner with the polishing pad; and brushing material removed from the polishing pad by moving at least one of the polishing pad and the brush elements relative to the other while the brush elements contact the polishing pad.

25. The method of claim 24, further comprising contacting the abrasive surface with the polishing pad simultaneously with contacting the brush elements with the polishing pad.

26. The method of claim 24 wherein positioning a polishing pad conditioner includes positioning a polishing pad conditioner having an abrasive portion with a fixed position relative to the brush portion.

27. The method of claim 24 wherein the conditioner includes a head and wherein the method further comprises releasably attaching at least one of the brush portion and the abrasive portion to the head.

28. The method of claim 24 wherein contacting an abrasive surface includes contacting an abrasive surface distributed over a plurality of abrasive regions, the abrasive regions being spaced apart from each other by brush elements.

29. The method of claim 24 wherein contacting brush elements includes contacting brush elements of a plurality of brush regions, the brush regions being spaced apart from each other by abrasive surfaces.

30. The method of claim 24 wherein contacting the brush elements includes contacting brush bristles that are recessed from the abrasive surface.

31. The method of claim 24 wherein contacting the abrasive surface includes contacting an abrasive surface that is recessed from the brush elements.

32. The method of claim 24, further comprising fixing a position of the abrasive surface relative to the brush elements while moving at least one of the polishing pad and the abrasive surface relative to the other.

33. The method of claim 24, further comprising removing the material from a microfeature workpiece and embedding the material in a surface of the polishing pad, prior to removing the material from the polishing pad.

34. A method for operating a system having features for conditioning microfeature workpiece polishing media, the method comprising:

positioning a polishing pad conditioner proximate to a microfeature workpiece polishing pad, the polishing pad conditioner having an abrasive portion with an abrasive surface and a brush portion with a plurality of brush elements, wherein the brush portion includes a first brush region and a second brush region, the abrasive portion is positioned outwardly from the first brush region, and the second brush region is positioned outwardly from the abrasive portion;

contacting the abrasive surface of the polishing pad conditioner with the polishing pad and simultaneously contacting the brush elements of the polishing pad conditioner with the polishing pad; and removing material from the polishing pad by moving at least one of the polishing pad and the polishing pad conditioner relative to the other while the abrasive surface and the brush elements contact the polishing pad.

35. The method of claim 34 wherein removing material includes removing material while the abrasive surface and the brush elements have a generally fixed position relative to each other.

36. The method of claim 34 wherein the conditioner includes a head and wherein the method further comprises releasably attaching at least one of the brush portion and the abrasive portion to the head.

37. The method of claim 34 wherein contacting the abrasive surface includes contacting an abrasive surface distributed over a plurality of abrasive regions, the abrasive regions being spaced apart from each other by brush elements.

38. The method of claim 34 wherein contacting brush elements includes contacting brush elements of a plurality of brush regions, the brush regions being spaced apart from each other by the abrasive surface.

39. The method of claim 34 wherein contacting the brush elements includes contacting brush bristles that are recessed from the abrasive surface.

40. The method of claim 34 wherein contacting the abrasive surface includes contacting an abrasive surface that is recessed from the brush elements.

41. The method of claim 34 wherein contacting a brush portion includes contacting a brush portion that at least partially surrounds the abrasive portion.

42. The method of claim 34, further comprising removing the material from a microfeature workpiece and embedding the material in a surface of the polishing pad, prior to removing the material from the polishing pad.

43. A method for operating a system having features for conditioning microfeature workpiece polishing media, the method comprising:

contacting a microfeature workpiece with a polishing surface of a polishing pad;

moving at least one of the polishing pad and the microfeature workpiece relative to the other to remove material from the microfeature workpiece;

forcing at least some of the material removed from the microfeature workpiece into the polishing surface of the polishing pad;

simultaneously contacting an abrasive surface and brush elements of a polishing pad conditioner with the polishing pad, wherein the brush elements form a first brush region and a second brush region, the abrasive surface is positioned outwardly from the first brush region, and the second brush region is positioned outwardly from the abrasive surface;

moving at least one of the polishing pad and the polishing pad conditioner relative to the other while the abrasive surface and the brush elements simultaneously contact the polishing pad and while the abrasive surface and the brush elements have a fixed position relative to each other;

extracting microfeature workpiece material from the polishing pad with the abrasive surface of the conditioner; and brushing the material extracted from the polishing pad with the brush elements of the polishing pad conditioner.

44. The method of claim 43 wherein the conditioner includes a head and wherein the method further comprises releasably attaching at least one of the brush portion and the abrasive portion to the head.

45. The method of claim 43 wherein contacting an abrasive surface includes contacting abrasive surfaces of a plurality of abrasive regions, the abrasive regions being spaced apart from each other by brush elements.

46. The method of claim 43 wherein contacting brush elements includes contacting brush elements of a plurality of brush regions, the brush regions being spaced apart from each other by abrasive surfaces.

47. The method of claim 43 wherein contacting the brush elements includes contacting brush bristles that are recessed from the abrasive surface.

48. The method of claim 43 wherein contacting the abrasive surface includes contacting an abrasive surface that is recessed from the brush elements.

49. A method for operating a system having features for conditioning microfeature workpiece polishing media, the method comprising:

positioning a polishing pad conditioner proximate to a microfeature workpiece polishing pad, the polishing pad conditioner having a first portion and a second portion proximate to the first portion, the first portion having a first hardness and the second portion having a second hardness less than the first hardness, wherein the second portion includes an inner region and an outer region, the first portion is positioned outwardly from the inner region, and the outer region is positioned outwardly from the first portion;

contacting the polishing pad with the first portion of the polishing pad conditioner;

removing material from the polishing pad by moving at least one of the polishing pad and the first portion relative to the other while the first portion contacts the polishing pad;

contacting the polishing pad with the second portion of the polishing pad conditioner; and sweeping material removed from the polishing pad by moving at least one of the polishing pad and the second portion relative to the other while the second portion contacts the polishing pad.

50. The method of claim 49 wherein the contacting the polishing pad with the first portion includes contacting the polishing pad with an abrasive surface.

51. The method of claim 49 wherein the contacting the polishing pad with the first portion includes contacting the polishing pad with brush elements.

52. The method of claim 49 wherein positioning a polishing pad conditioner includes positioning a polishing pad conditioner having a first portion that is fixed relative to the second portion.

53. The method of claim 49 wherein contacting the polishing pad with the second portion includes contacting the polishing pad with the first and second portions simultaneously.

54. A system including features for conditioning microfeature workpiece polishing media, the system comprising:

a polishing pad support having a support surface positioned to carry a microfeature workpiece polishing pad; and a conditioner positioned at least proximate to the polishing pad support to condition a polishing pad carried by the polishing pad support, the conditioner including:

an abrasive portion having an abrasive surface positioned to contact the polishing pad carried by the polishing pad support, wherein the abrasive portion includes a first abrasive region and a second abrasive region; and a brush portion having brush elements positioned proximate to the abrasive portion, wherein the brush portion is positioned outwardly from the first abrasive region, and the second abrasive region is positioned outwardly from the brush portion.

55. The system of claim 54 wherein the brush elements are positioned to contact the polishing pad simultaneously with the abrasive surface contacting the polishing pad.

56. The system of claim 54 wherein the abrasive surface includes diamonds.

57. The system of claim 54 wherein the conditioner includes a head and wherein the head carries the abrasive portion and the brush portion of the conditioner.

58. The system of claim 54 wherein the conditioner includes a head and wherein the head carries the abrasive portion and the brush portion of the conditioner, further wherein at least one of the brush portion and the abrasive portion is releasably attached to the head.

59. A system including features for conditioning microfeature workpiece polishing media, the system comprising:

a polishing pad support having a support surface positioned to carry a microfeature workpiece polishing pad; and a conditioner positioned at least proximate to the polishing pad support to condition a polishing pad carried by the polishing pad support, the conditioner including:

an abrasive portion having an abrasive surface positioned to contact the polishing pad carried by the polishing pad support; and a brush portion having brush elements positioned proximate to the abrasive portion, wherein one of the brush portion and the abrasive portion has a generally cross-shaped planform configuration with a plurality of arm regions extending outwardly from a central region, and wherein the other of the brush portion and the abrasive portion includes a plurality of intermediate regions positioned between the arm regions.

60. The system of claim 59 wherein the brush elements are positioned to contact the polishing pad simultaneously with the abrasive surface contacting the polishing pad.

61. The system of claim 59 wherein the abrasive surface includes diamonds.

62. The system of claim 59 wherein the conditioner includes a head and wherein the head carries the abrasive portion and the brush portion of the conditioner.

63. The system of claim 59 wherein the conditioner includes a head and wherein the head carries the abrasive portion and the brush portion of the conditioner, further wherein at least one of the brush portion and the abrasive portion is releasably attached to the head.

64. The system of claim 59 wherein the brush portion and the abrasive portion together have a generally circular planform shape with a generally circular periphery.

65. A system including features for conditioning microfeature workpiece polishing media, the system comprising:

a polishing pad support having a support surface positioned to carry a microfeature workpiece polishing pad; and a conditioner positioned at least proximate to the polishing pad support to condition a polishing pad carried by the polishing pad support, the conditioner including:

an abrasive portion having an abrasive surface positioned to contact the polishing pad carried by the polishing pad support; and a brush portion having brush elements positioned proximate to the abrasive portion, wherein the abrasive portion includes a plurality of discontinuous abrasive regions, the discontinuous abrasive regions being spaced apart from each other by the brush elements.

66. A system including features for conditioning microfeature workpiece polishing media, the system comprising:

a polishing pad support having a support surface positioned to carry a microfeature workpiece polishing pad; and a conditioner positioned at least proximate to the polishing pad support to condition a polishing pad carried by the polishing pad support, the conditioner including:

an abrasive portion having an abrasive surface positioned to contact the polishing pad carried by the polishing pad support; and a brush portion having brush elements positioned proximate to the abrasive portion, wherein the brush portion includes a plurality of brush regions, the brush regions being spaced apart from each other by the abrasive portion.

* * * * *